US006135164A

United States Patent [19]

Celoudoux et al.

[11] Patent Number: 6,135,164

[45] Date of Patent: Oct. 24, 2000

[54] APPARATUS AND METHOD FOR PREPARING WIRES IN A HARNESS MAKING MACHINE

[75] Inventors: Jean-Paul Celoudoux, Aix en Provence; Bruno Daugy, St. Maximin, both of France

[73] Assignee: Komax Holding AG, Dierikon, Switzerland

[21] Appl. No.: 09/153,560

[22] Filed: Sep. 15, 1998

[30] Foreign Application Priority Data

Sep. 29, 1997 [EP] European Pat. Off. ..... 97402256

[51] Int. Cl.[7] ..... B21F 23/00

[52] U.S. Cl. ..... 140/102; 83/282

[58] Field of Search ..... 29/857, 748, 755; 83/282, 439; 140/102, 140

[56] References Cited

U.S. PATENT DOCUMENTS

| | | | |
|---|---|---|---|
| 3,927,590 | 12/1975 | Gudmestad et al. | 83/151 |
| 5,634,385 | 6/1997 | Ohta et al. | 83/282 |

FOREIGN PATENT DOCUMENTS

| | | |
|---|---|---|
| 0 007 681 A1 | 2/1980 | European Pat. Off. . |
| 0 271 743 A2 | 6/1988 | European Pat. Off. . |
| 1 485 230 | 9/1977 | United Kingdom . |
| 2 049 500 | 12/1980 | United Kingdom . |
| 1 587 342 | 4/1981 | United Kingdom . |
| 2 193 124 | 2/1988 | United Kingdom . |
| WO 97/32370 | 9/1997 | WIPO . |

*Primary Examiner*—Lowell A. Larson

*Attorney, Agent, or Firm*—Cohen, Pontani, Lieberman & Pavane

[57] ABSTRACT

An apparatus for preparing and positioning U-shaped loops of wires on a conveyor of a harness making machine comprises transfer grippers moveable in a vertical direction V. The transfer grippers are for transferring the wire loops from the selector and cutting station into the jaws of conveyor grippers. Provision of the transfer grippers enables initial feeding and cutting of the wire loops during movement of the conveyor grippers thereby decreasing cycle time.

7 Claims, 12 Drawing Sheets

APPARATUS AND METHOD FOR PREPARING WIRES IN A HARNESS MAKING MACHINE

BACKGROUND OF THE INVENTION

1. Field of the Invention

This invention relates to an apparatus and a method for automatically preparing lengths of wire to be processed in a cable harness making machine.

2. Description of the Prior Art

In automatic harness making machines, it is known to provide a linear conveyor on which a plurality of grippers are transported for moving electrical wires to various wire processing stations, such as wire selection and cutting devices, terminal crimping stations, and connectors loading stations. A complex harness comprising a plurality of electrical wires terminated to various connectors can thus be manufactured in an automated manner.

Wires are typically held at both ends in adjacent conveyor grippers such that the wires form U-shaped loops during transport. A first processing station in a harness making machine is usually a wire selector and cutting station, where a wire to be processed is selected from a long roll of wire. The selected wire is held at one end during feeding of a specified length of wire, subsequently held at the other end, cut, and the resulting loop of wire moved by the selector into respective adjacent conveyor grippers for transport to further processing stations. The selection and cutting to length of wires often requires a longer cycle time than other harness making steps, such as termination of wires to contacts, thereby slowing the whole harness making procedure.

SUMMARY OF THE INVENTION

It is an object of this invention to provide an apparatus for preparing lengths of wire of an harness, in a rapid, versatile and reliable manner.

Disclosed herein is an apparatus for preparing wires, comprising a wire selector device, a wire cutter, and a conveyor having conveyor grippers therealong, the grippers for holding and transporting wire ends to further processing stations of a harness making machine along the conveyor, the wire selector device comprising a wire length drive for pulling a certain length of wire from a wire source, a sensor for measuring the length of wires, and a movable gripper for holding a first end of wire and reorienting the first end such that a U-shaped loop of wire is formed when the wire is driven and subsequently cut at a second end by the wire cutter, wherein the apparatus further comprises a wire end transfer device comprising a pair of grippers for seizing and transferring the first and second wire ends from the selector and cutting devices to the conveyor grippers. Advantageously, the transfer of wires from the selector and cutting devices can occur simultaneously to the subsequent wire selection and cutting operation, and during opening of the conveyor grippers, such that a rapid cycle time is achieved. The wire selection and cutting device may be positioned above the conveyor such that the transfer device moves down in a simple movement from the selector device to the conveyor grippers. The pair of transfer grippers are provided in a pitch similar to the pitch of adjacent conveyor grippers such that both wire ends are moved into the conveyor grippers as the transfer device descends. Further advantageous aspects of this invention are set forth in the claims, or will be apparent from the following description and drawings.

BRIEF DESCRIPTION OF THE DRAWINGS

FIGS. 1–12 show an apparatus according to this invention, where respective FIGS. 1–12 showing successive steps in the selection, preparation and cutting to length of a wire, and transfer of the wire to conveyor grippers.

DETAILED DESCRIPTION OF THE PREFERRED EMBODIMENT

Figure 5:
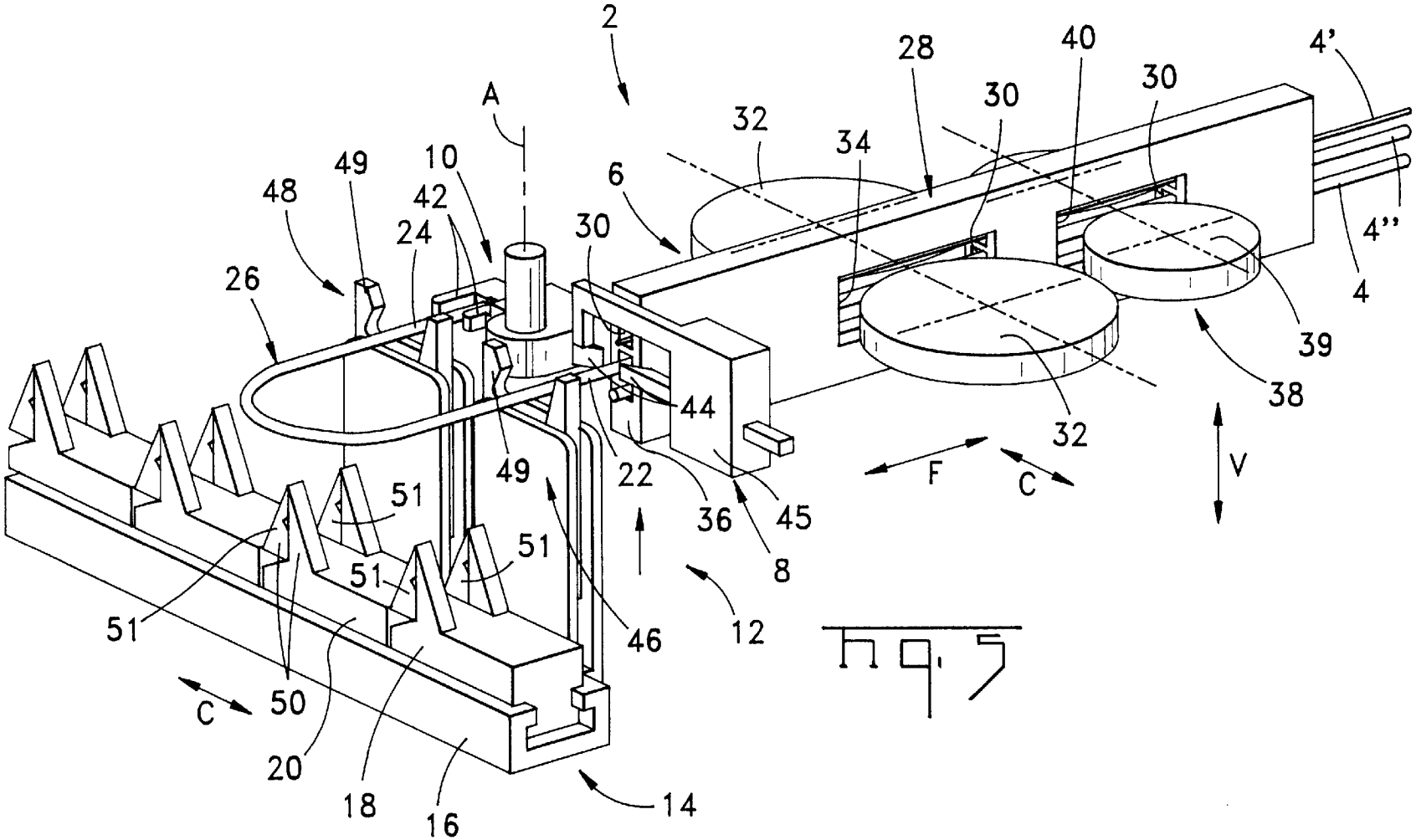

Referring mainly to FIG. 5, an apparatus 2 for preparing wires 4, 4', 4" comprises a wire selector 6, a wire cutter 8, a wire end reorientation gripper 10, a wire loop transfer device 12, and a conveyor 14. The conveyor 14 comprises a support 16 and grippers 18, 20 for gripping first and second ends 22, 24 of selected wire loops 26 and transporting them along the conveyor support to further wire end processing stations of a harness making machine.

The wire selector 6 comprises a wire support 28 with a plurality of wire guide channels 30 extending therethrough for receiving a row of wires 4, 4', 4" which may be of different sizes, colours, or type. The different wires are provided to enable a complex harness to be produced, where all the different wires types needed for the harness are guided in the wire selector 6. The wire guide channels 30 extend in a wire feed direction F perpendicular to the direction C of the conveyor 14. The selector 6 further comprises a drive with a pair of drive wheels 32 engaging opposite sides of a selected wire, through a cut-out or window 34 in the wire support 28. The drive wheels are actuated by a motor (not shown) and drive the selected wire by fictional grip of the wire between the wheels, in the direction F out of the end 36 of the channel 30.

In order to feed a specific length of wire, the selector further comprises a feed length sensor 38 comprising one or two wheels 39 that frictionally engage the selected wire through a cut-out 40 and detect feed length by measuring the rotation of the wheels 39. The selector support 28 is movable (by a mechanism not shown) up and down in a vertical direction V such that the different wires 4, 4', 4" can be positioned at the level of the wheels 32, 39 and other elements for cutting and transferring the selected wire.

The reorientation gripper 10 comprises jaws 42 that can be opened and closed for releasably gripping the first end 24 of the selected wire 4", the jaws rotatably mounted about an axis A extending in the vertical direction V such that the wire end 24 can be gripped at the front end 36 of the support, and rotated about 180° to face the selector 6, as shown in FIG. 5.

The wire cutter 8 is positioned proximate the front end 36 of the wire guide channels 30 to cut the selected wire 4" after the full length has been fed. The cutter 8 comprises cutting blades 44, at least one 45 being movable and controlled by the harness making machine computer. The cutting blades are arranged on opposite sides of the wire second end 22 as shown in FIG. 5.

The wire loop transfer device 12 is movably supported to the apparatus, the transfer device having a pair of transfer grippers 46, 48 movable in the vertical direction V from the position of the selected wire ends 22, 24 at the wire selector 6, to the level of conveyor grippers 18, 20 on the conveyor support 16. The transfer device 12 is for transferring selected wire loops 26 from the selector 6 to the conveyor 14. The grippers 46, 48 have movable jaws controlled by the computer of a harness making machine such that the jaws can be opened and closed in a synchronised manner with the conveyor 14 and wire selector 6. The spacing or pitch between the first and second grippers 46, 48 is the same as the spacing between adjacent conveyor grippers 18, 20, and substantially the same as the distance between the reorientation gripper 10 and wire guide channels 30 of the selector support 28 when the reorientation gripper is rotated by a 180° as shown in FIG. 5. The transfer grippers 46, 48 can thus be actuated in a simple manner in the vertical direction for picking the selected wires 26 at the selector 6 and descending the first and second wire ends 22,24 directly in respective adjacent conveyor grippers 18, 20 in a single movement. The conveyor grippers 18, 20 comprise jaws 50, at least one jaw 51 of each pair of jaws being actionable by the harness making machine for clamping or unclamping of wire loops.

Figure 1:
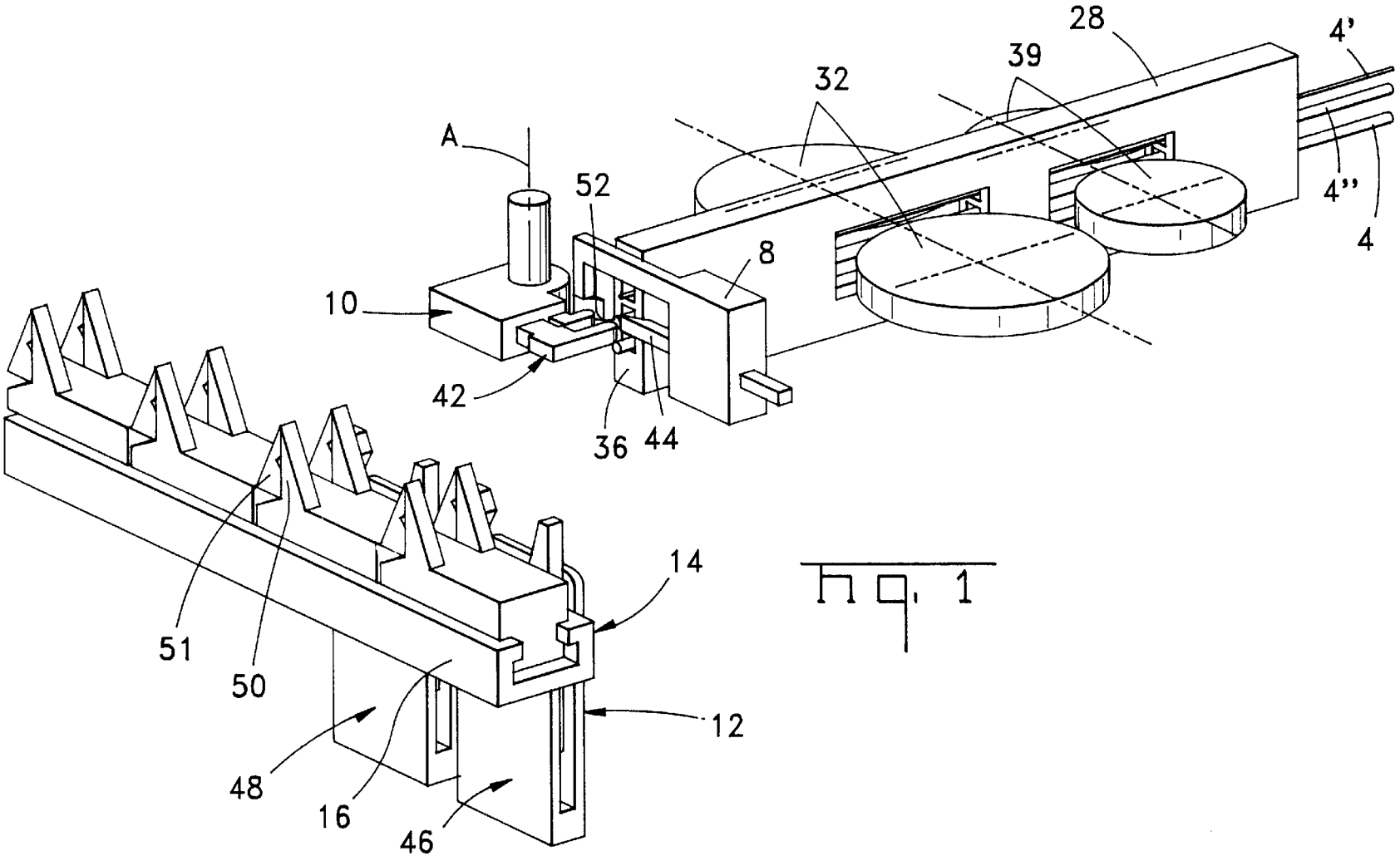

Referring now to FIGS. 1–12, preparation of a wire for processing in a harness making machine will now be described. Referring first to FIG. 1, the support 28 of the wire selector 6 is moved in the vertical direction V until a particular selected wire 4" to be prepared is at an operational height, in alignment with the drive wheels 32 and reorientation gripper jaws 42. An end 52 of the selected wire 4" extends slightly beyond the front face 36 of the selector wire support 28. Extension of the wire end 52 should correspond to the level of the wire cutting blades 44, resulting from cutting of the wire in a previous operation. The transfer grippers 46, 48 are in a lower position remote from the selected wire 52.

Figure 2:
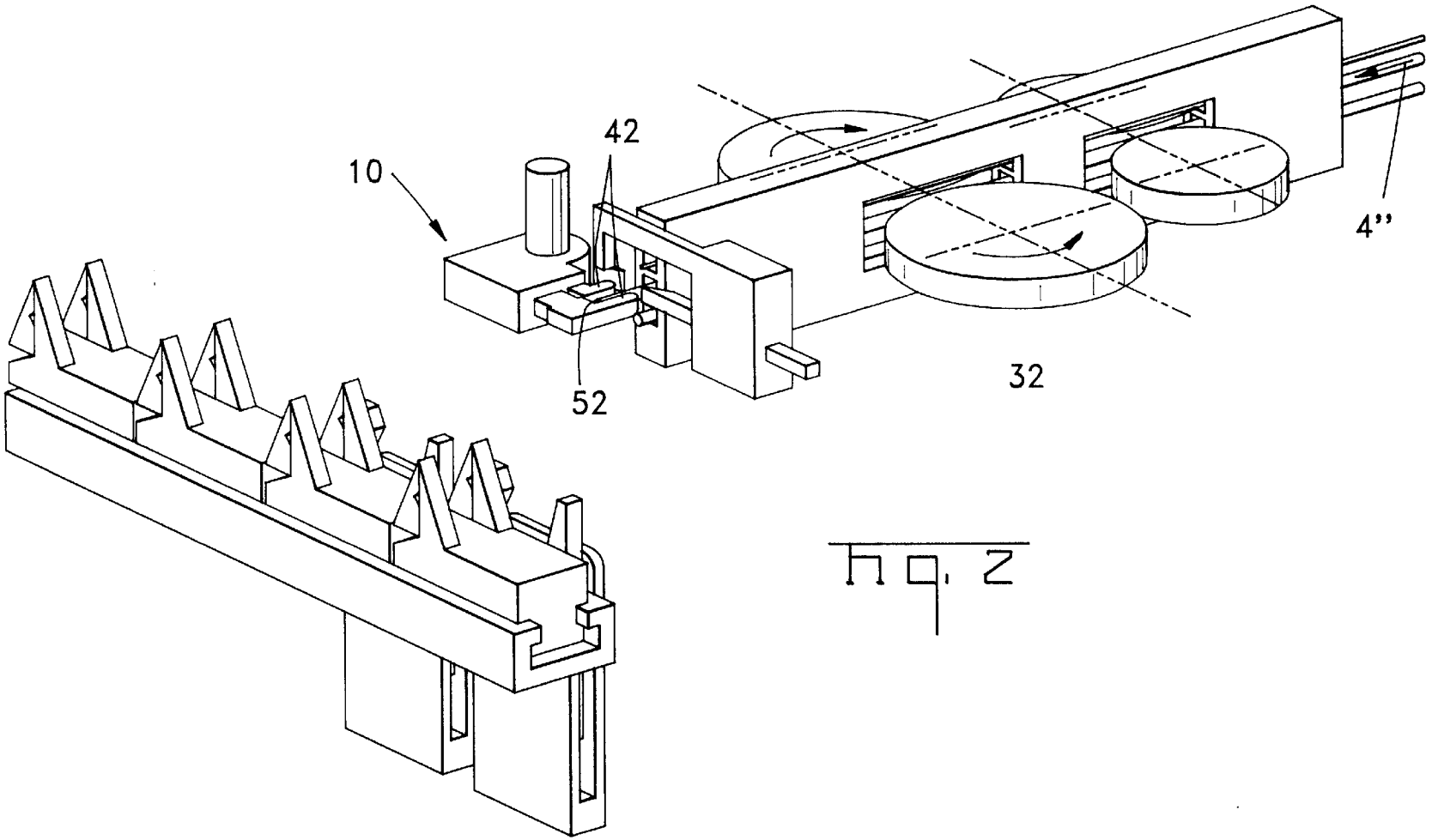

Referring to FIG. 2 showing the subsequent operation, the drive wheels 32 are rotated upon command of the harness making machine computer, to feed the selected wire 4" a short distance (e.g. 15 mm) such that the wire end 52 inserts between the jaws 42 of the reorientation gripper that are in an open position. In the subsequent step shown in FIG. 3, the jaws 42 of the reorientation gripper 10 are closed thereby clamping the end of the selected wire 4".

Figure 4:
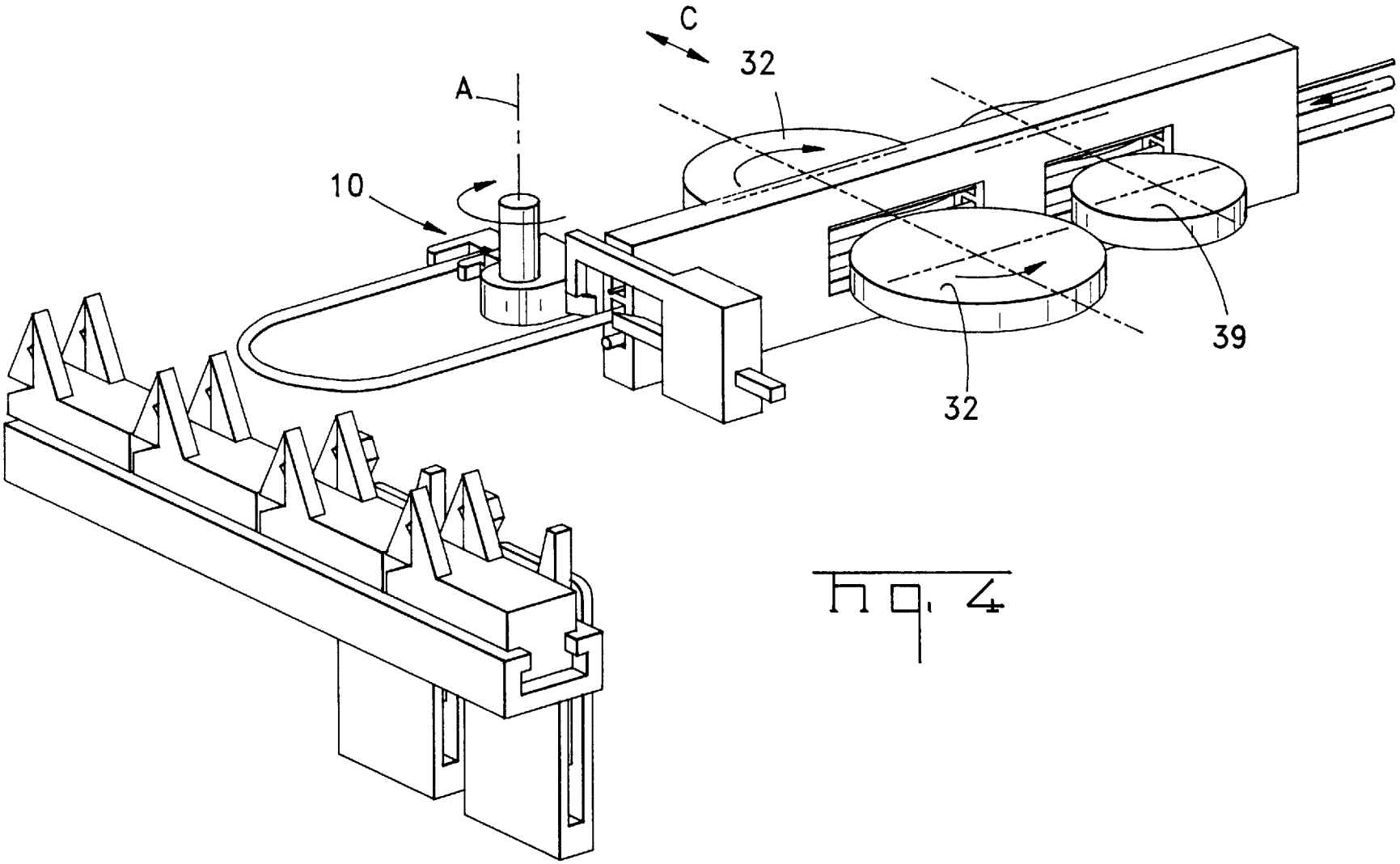

In the subsequent operation shown in FIG. 4 the reorientation gripper 10 is rotated by 180° about the axis A and simultaneously the drive wheels 32 are driven until the required length of wire is attained. The required length is measured by the rotation of the sensor wheels 39 that frictionally engage the selected wire 4".

In the subsequent operation shown in FIG. 5, the transfer grippers 46, 48 are moved in the vertical direction V to an upper position whereby the jaws 49 are in the open position flanking respective first and second wire ends 22, 24 of the selected wire loop 26.

Figure 6:
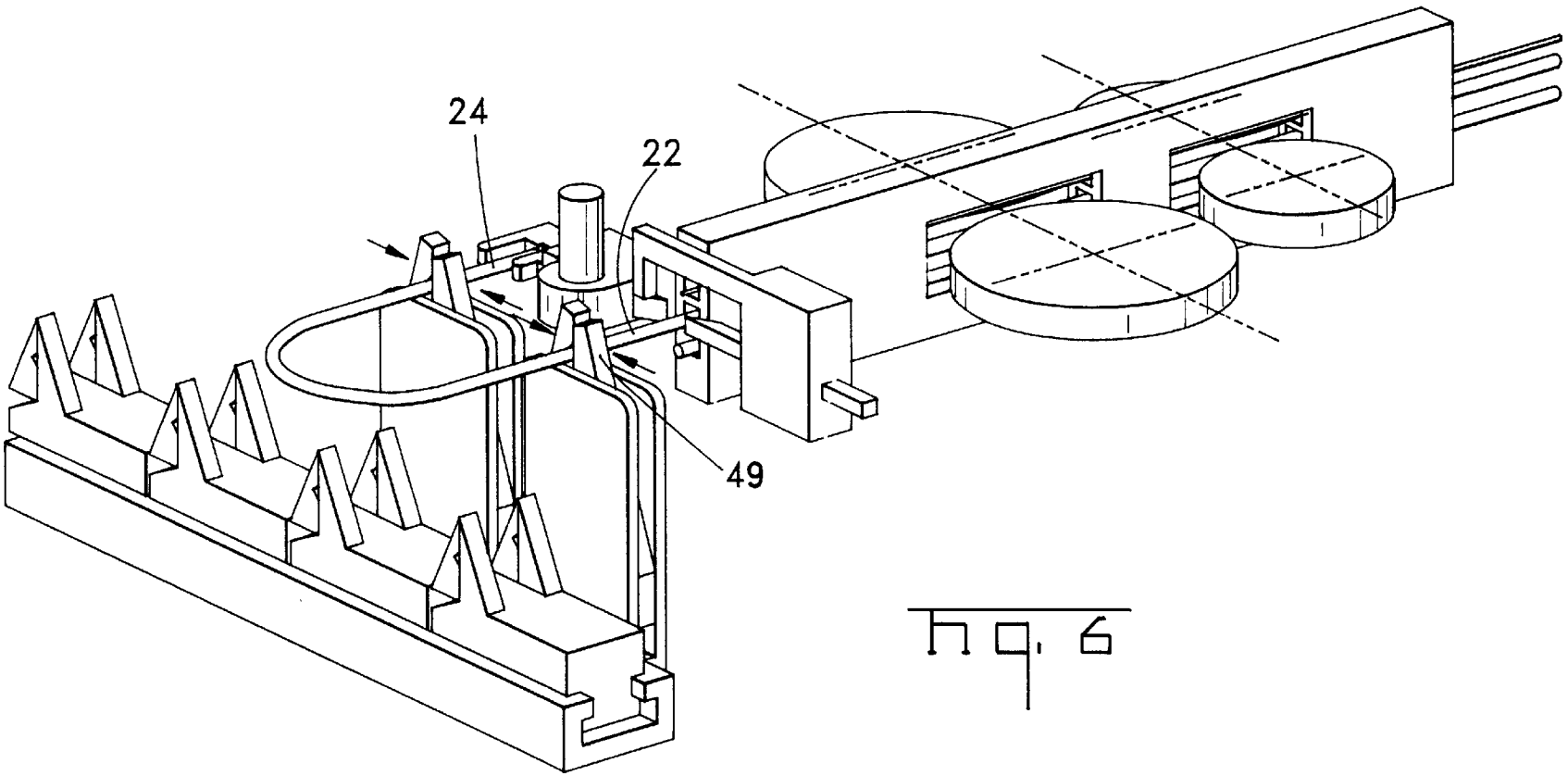
Figure 7:
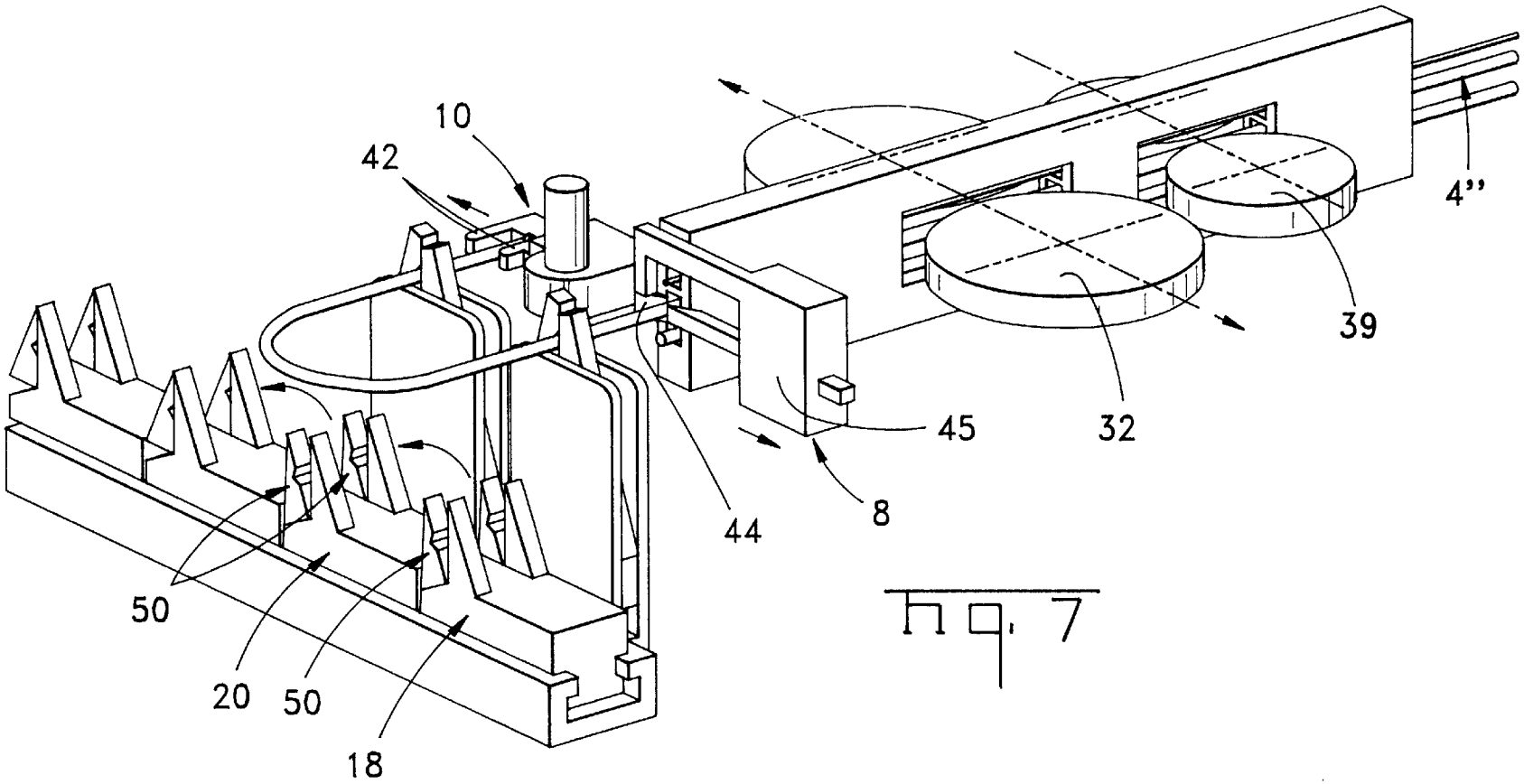

In the subsequent step shown in FIG. 6, the transfer gripper jaws 49 are actuated into a closed position for clamping the wire ends 22, 24.

Figure 7:
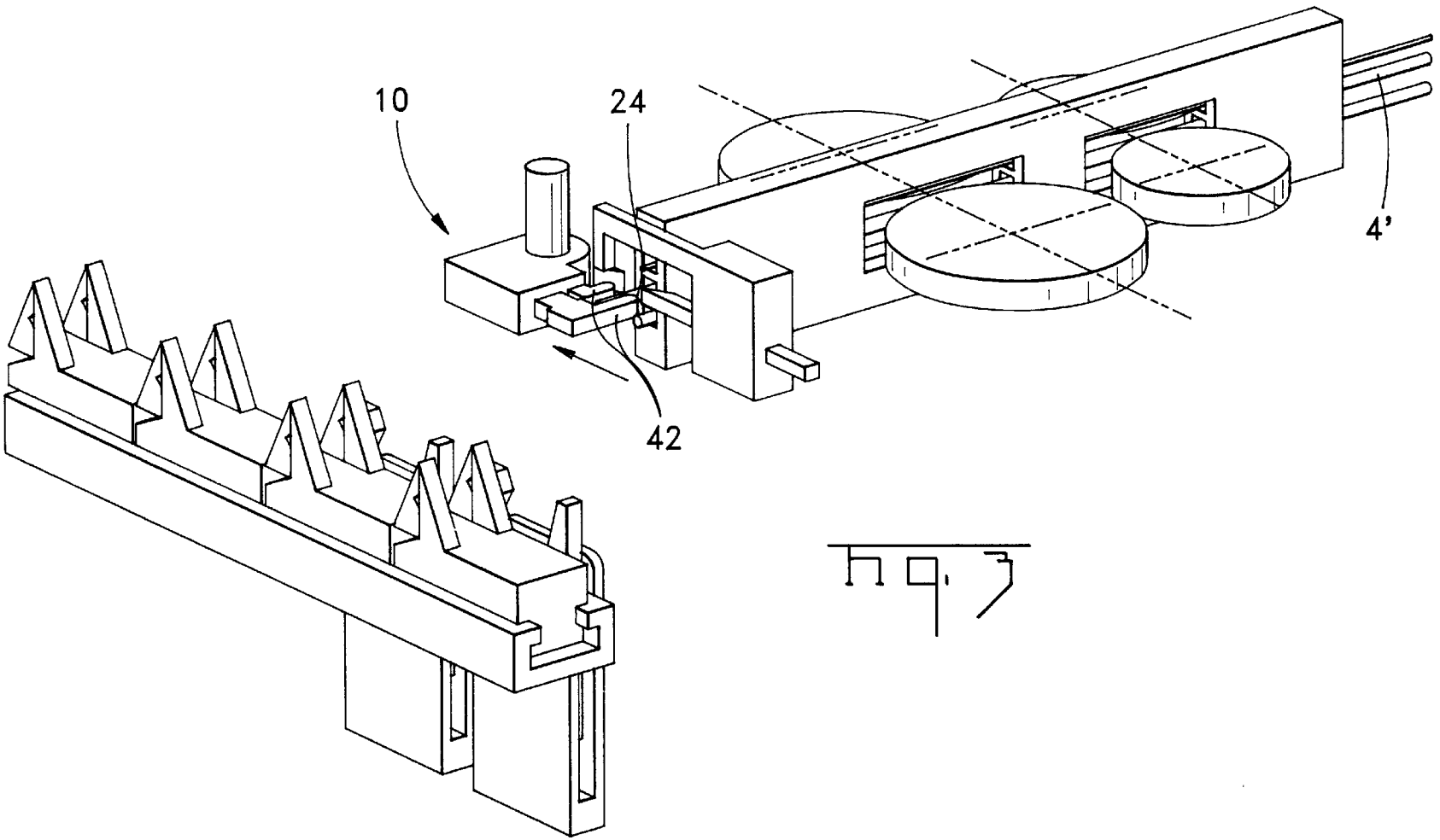

In the subsequent operations shown in FIG. 7, the following actions occur simultaneously: the jaws 42 of the reorientation gripper 10 open, the movable cutter blade 45 is closed thereby cutting the first end 22 of the wire loop 26 free from the selected wire 4"; the movable jaw of the conveyor grippers 18, 20 positioned below the first and second wire end branches 22, 24 are opened; and the feed and sensor wheels 32, 39 are moved out of engagement with the selected wire 4". Both the feed and sensor wheels 32, 39 are movable in the direction C out of engagement with the wire to allow vertical movement of the support 28.

Figure 8:
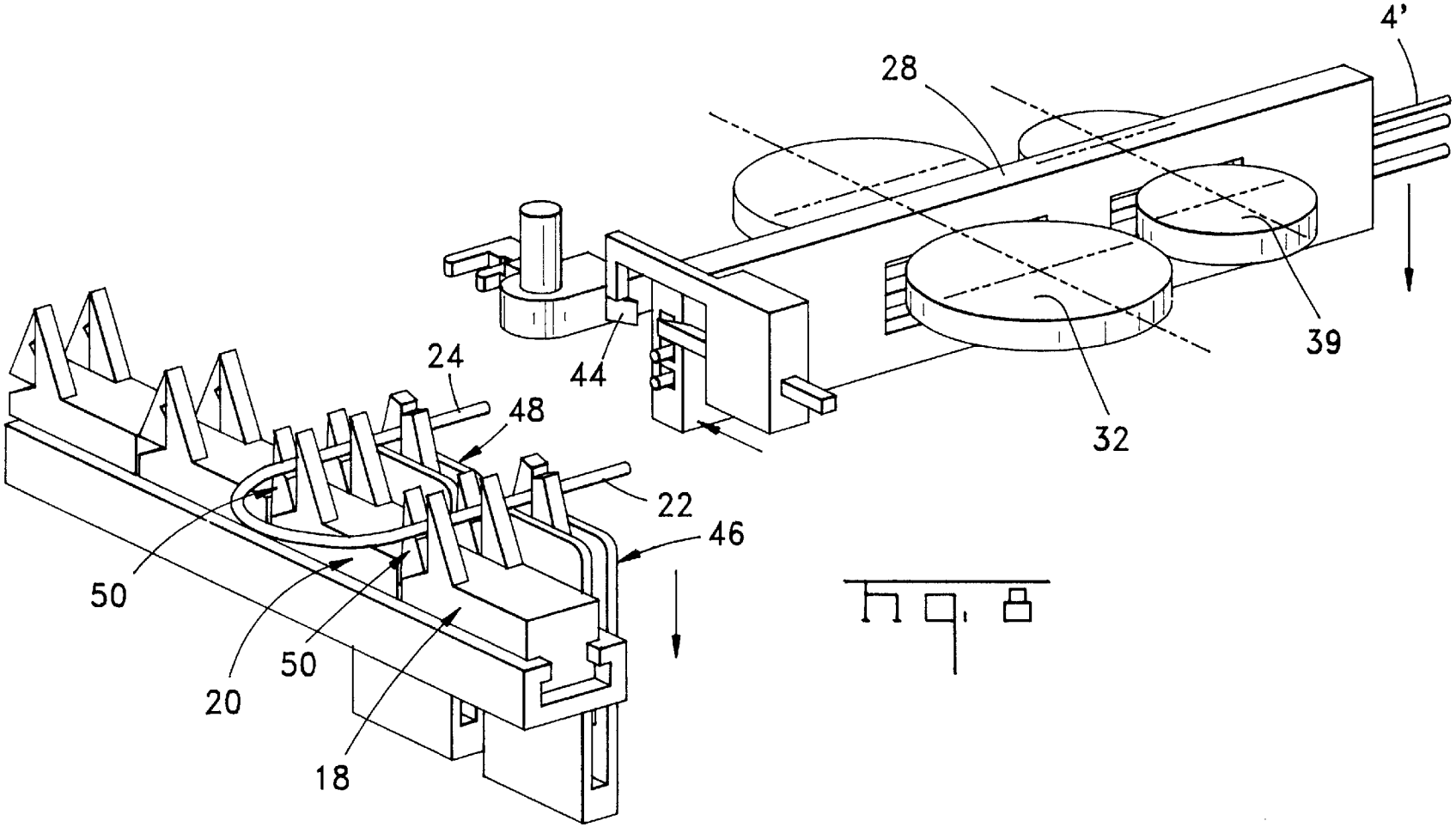

In the subsequent operation shown in FIG. 8 the following operations occur simultaneously: the wire cutter movable blade 45 moves to the open position; the wire selector support 28 moves vertically until another selected wire 4' to be processed is at the level of the wheels 32, 39; and the transfer gripper 46, 48 descend into the lower position thereby lowering the selected wire ends 22, 24 between the jaws 50 of respective first and second conveyor grippers 18, 20. In the latter operation shown in FIG. 8, it is also possible that the wire selector support 28 does not vertically move, if the next wire to be prepared is the same wire as the preceding.

Figure 9:
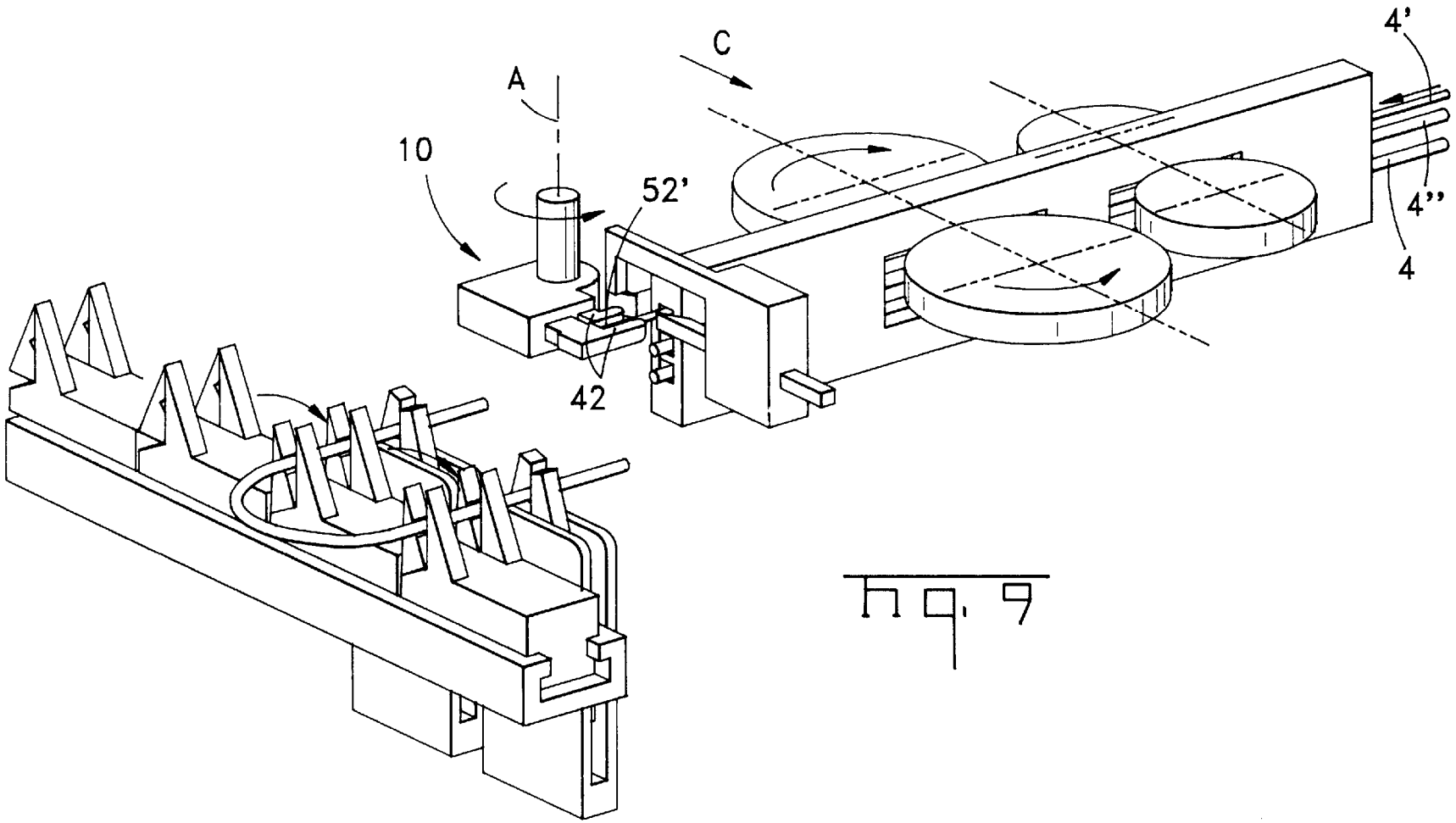

In the subsequent operations shown in FIG. 9, the feed and sensor wheels are moved in the direction C towards each other thereby engaging the selected wire 4'. Subsequently, the following operations occur simultaneously: the selected wire is advanced a small distance (e.g. 15 mm); the reorientation gripper 10 is rotated 180° to its initial position whereby the open jaws 22 receive the end 52 of the selected wire 4'; the conveyor grippers jaws 50 are closed thereby clamping the wire ends 22, 24.

Figure 10:
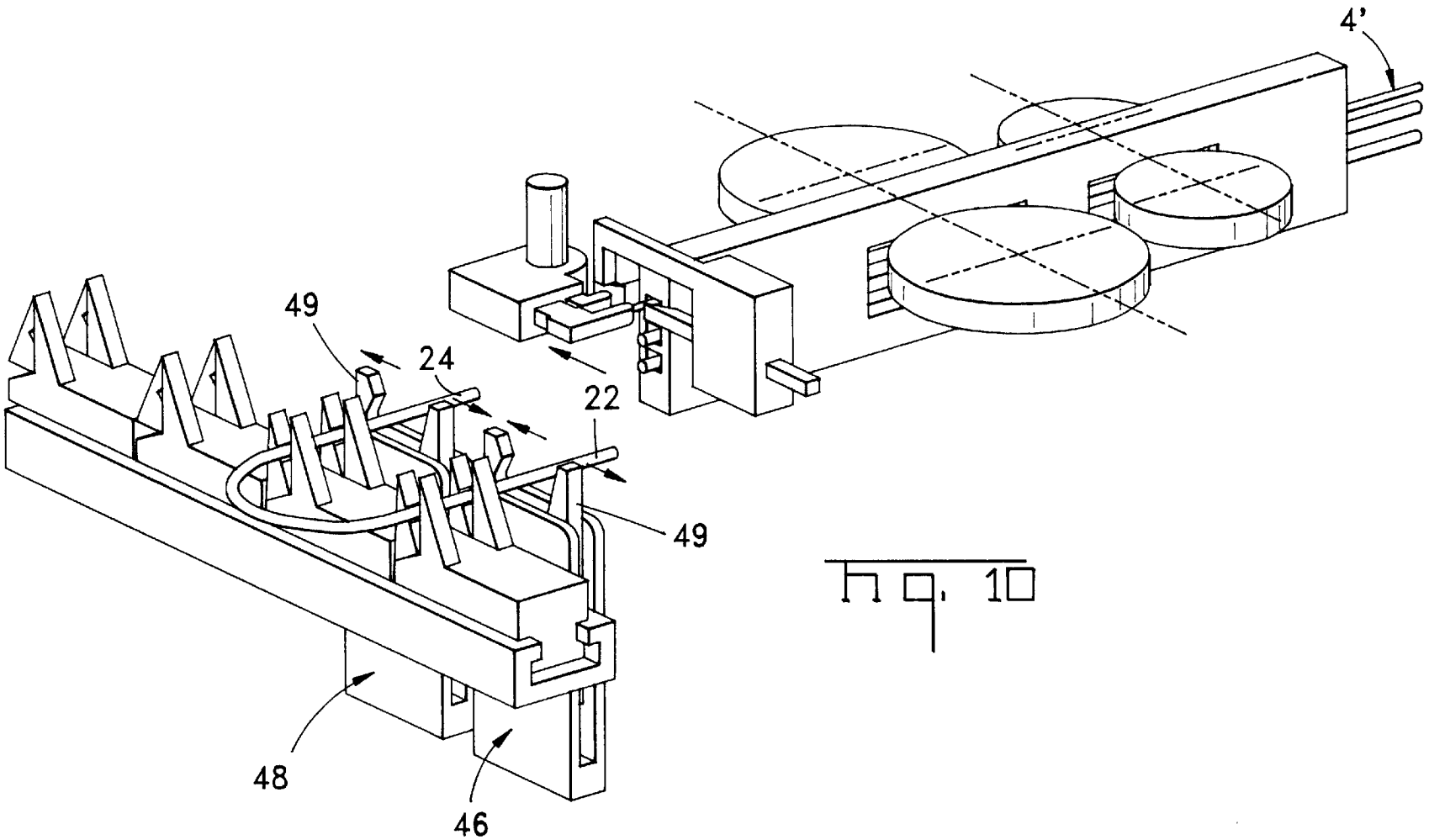

In the subsequent operation shown in FIG. 10, the following operations occur simultaneously: the jaws 42 of the reorientation gripper 10 are closed on the end 52' of the selected wire 4' and the jaws 49 of the transfer grippers 46, 48 are opened to release the selected wire loop ends 22, 24.

Figure 11:
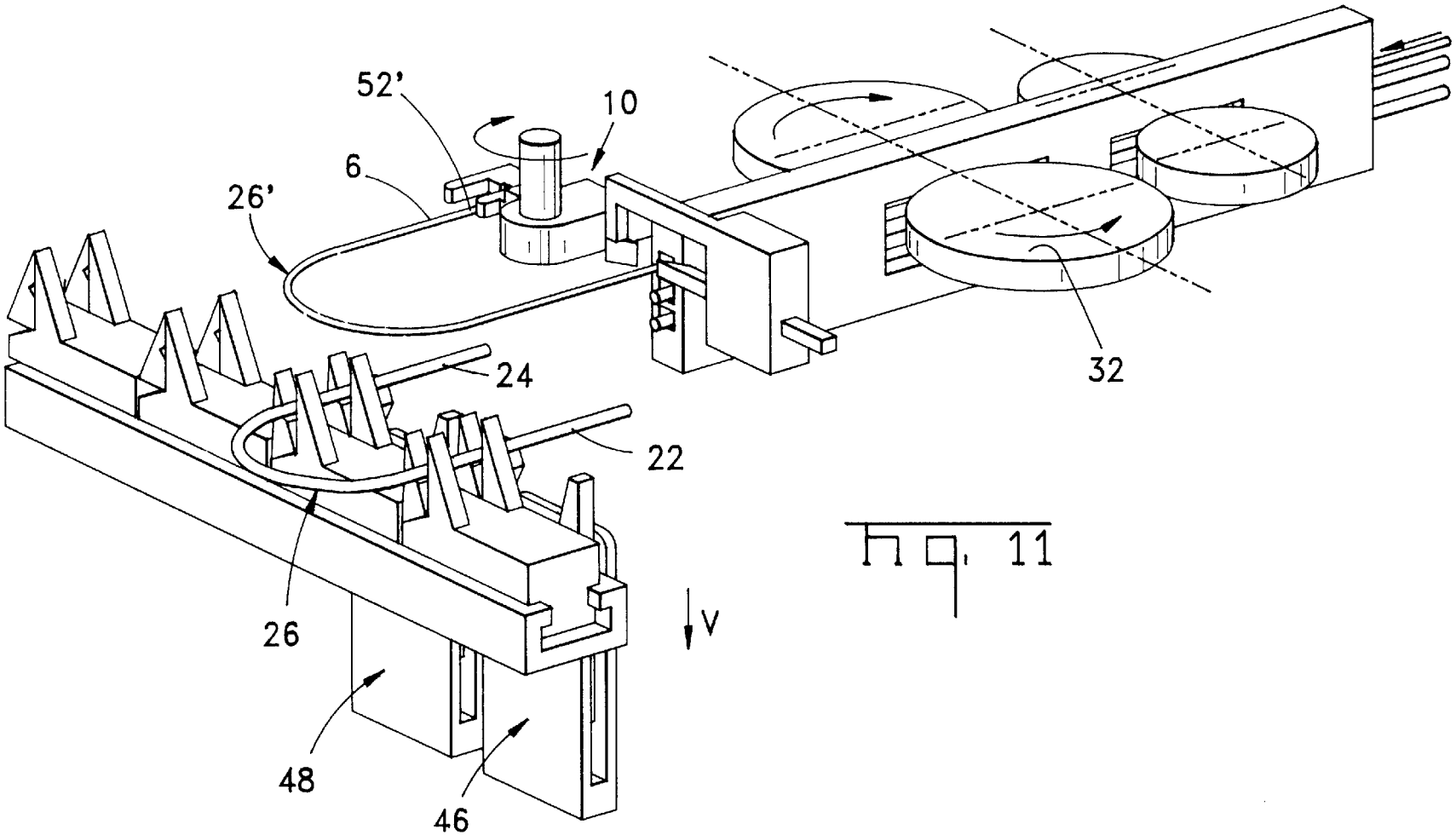

In the subsequent steps showing in FIG. 11, the following operations occur simultaneously: the newly selected wire 4' is driven to its required length by the feed wheels 32; the reorientation gripper 10 rotates 180° until the end 52' faces the selector 6 thereby forming a U-shaped wire loop 26'; the transfer grippers 46, 48 descend further in the vertical direction V to a lower conveying position to enable movement of the conveyor grippers 18, 20 in the conveying direction C without interfering with the preceding selected wire loop 26.

Figure 12:
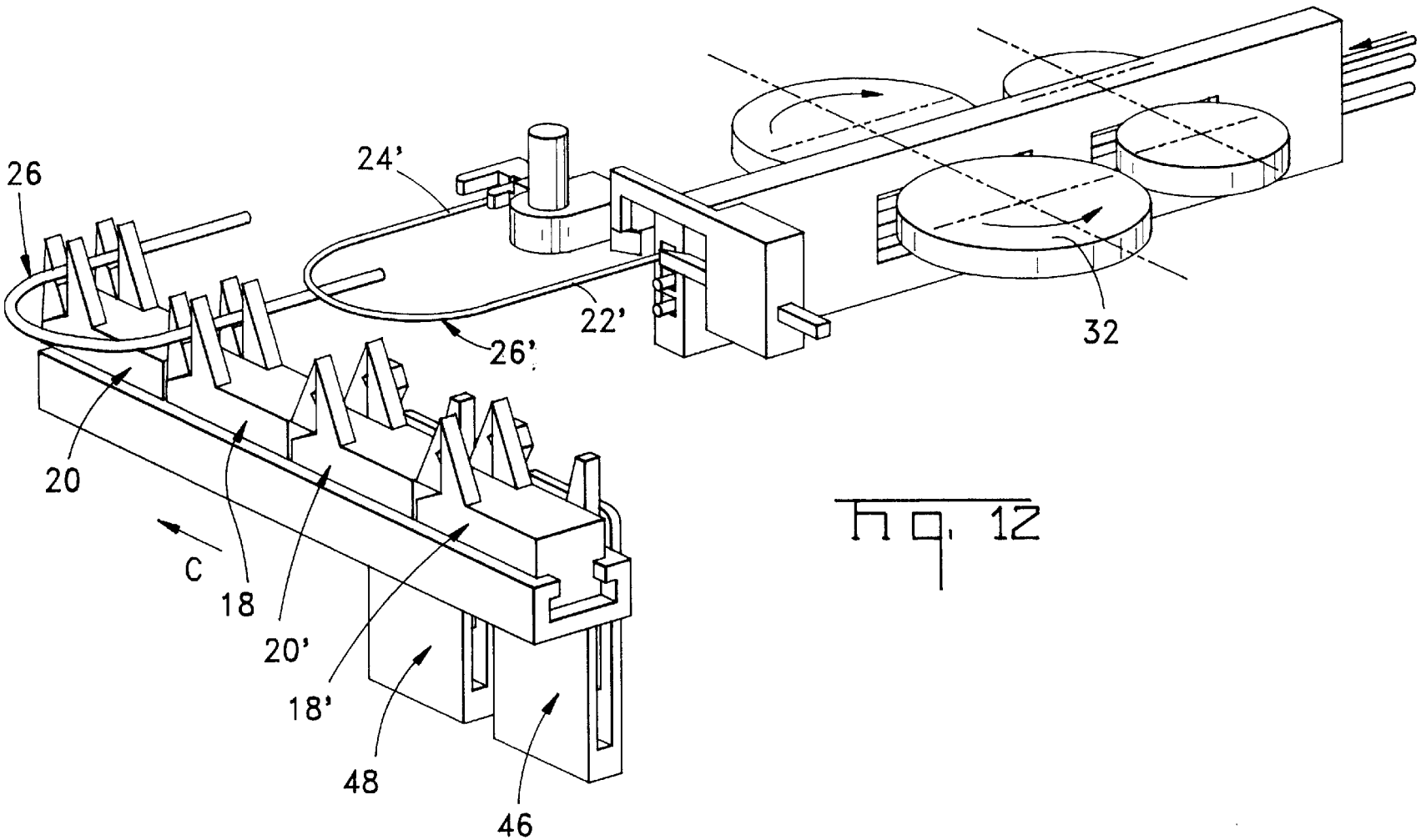

In the subsequent step shown in FIG. 12, the conveyor grippers 18, 20 are advanced in the conveyor direction C such that a new pair of conveying grippers 18', 20' are positioned below the newly selected wire loop 26'. The cycle continues with the next operations corresponding to those described for FIG. 4, with the newly selected wire 26'.

Advantageously, the transfer grippers 46, 48 enable the wire loop to be prepared with a number of simultaneous operations, for example feeding of the wire loop during movement of the conveyor grippers, such that a rapid manufacturing cycle time is achieved. In addition, the simple vertical movement of the transfer grippers 46, 48 arranged at the pitch of the adjacent conveyor grippers 18, 20, and where the selector 6 is positioned above the conveyor, enables simple and rapid transfer of the wire ends of the loop from the selector to the conveyor.

I/we claim:

1. An apparatus for preparing wires, comprising a wire selector, a wire cutter arranged at a level, and a convey having conveyor grippers therealong, the conveyor grippers for holding and transporting wire ends to further processing stations of a harness making machine, the wire selector comprising a wire support configured to support a plurality of the wires above one another, the wire support being vertically movable so that different wires are respectively positionable at the level of the wire cutter, a drive for feeding a certain length of wire from a wire source, a sensor for measuring the length of wire being fed, and a movable reorientation gripper for holding an end of selected wire, the reorientation gripper being movable about a vertical axis through 180° for reorienting the wire end such that a U-shaped loop of wire is formed when the wire is driven and subsequently cut at another end by the wire cutter, wherein the apparatus further comprises a wire end transfer device comprising a pair of grippers for seizing and transferring first and second wire ends from the selector and reorientation gripper to the convey grippers, the transfer grippers being movable in a vertical direction between the selector and the conveyor for transporting the selected wire loop from the selector directly into jaws of the conveyor grippers.

2. The apparatus of claim 1 wherein the transfer grippers are provided at a pitch corresponding to the pitch between adjacent conveyor grippers.

3. The apparatus of claim 1 wherein the transfer grippers are movable vertically to a lower conveying position below the jaws of the conveyor grippers to allow passage of selected wires past the transfer grippers in a conveying direction.

4. A method of preparing selected wire loops comprising the following steps:

feeding a selected wire from a plurality of wires arranged above one another in a wire support to a wire cutter by moving the wire support up and down so that the wire is at a level of the cutter;

gripping an end of the selected wire with a reorientation gripper from the selector;

substantially simultaneously rotating the reorientation gripper 180° and feeding a certain length of the selected wire to form a wire loop having first and second ends facing substantially in the same direction;

raising transfer grippers to an upper position and clamping the first and second ends with the transfer grippers;

cutting the selected wire at the first end and releasing the second end from the reorientation gripper; and opening jaws of conveyor grippers and descending the transfer grippers to a lower position whereby the first and second ends of the selected wire loop are received by a respective said first and second conveyor grippers.

5. The method of claim 4 wherein the following subsequent operations are provided; lowering the transfer grippers to a lower conveying position whereby the transfer grippers do not interfere with the selected wire loop.

6. The method of claim 4 wherein during the steps of transfer of the transfer grippers from the selector to the conveyor, the selector is moved if necessary to present a newly selected wire at the height of the reorientation gripper.

7. The method of claim 4 wherein during clamping and conveying of the selected wire loop by the conveyor grippers, a new selected wire loop is formed by rotation of the reorientation gripper and feeding of a length of selected wire to form the new loop.

* * * * *